US009121680B2

(12) United States Patent
Morgan et al.

(10) Patent No.: US 9,121,680 B2
(45) Date of Patent: Sep. 1, 2015

(54) AIR VEHICLE WITH CONTROL SURFACES AND VECTORED THRUST

(71) Applicant: Raytheon Company, Waltham, MA (US)

(72) Inventors: Robert W Morgan, Tucson, AZ (US); James P Normoyle, Tucson, AZ (US); Kurt J Wuest, Tucson, AZ (US); David Drake, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 423 days.

(21) Appl. No.: 13/743,829

(22) Filed: Jan. 17, 2013

(65) Prior Publication Data

US 2014/0197270 A1 Jul. 17, 2014

(51) Int. Cl.
*F42B 10/62* (2006.01)
*F42B 10/64* (2006.01)
(Continued)

(52) U.S. Cl.
CPC ..... *F42B 10/64* (2013.01); *F42B 10/62* (2013.01); *F42B 10/66* (2013.01)

(58) Field of Classification Search
CPC ..... F42B 10/60; F42B 10/62; F42B 10/64; F42B 10/66; F42B 10/661; F42B 10/663; F42B 10/665; F42B 10/666; F42B 10/668
USPC ..... 244/158.1, 158.9, 159.1, 159.3, 244/3.1–3.3, 171.1, 171.2, 75.1, 76 R, 220, 244/221, 234, 2, 34 R, 35 R, 36, 45 R, 244/46–49, 45 A, 171.3, 171.4, 173.1; 318/560, 563, 565
See application file for complete search history.

(56) References Cited

U.S. PATENT DOCUMENTS 3,028,122 A * 4/1962 Riebe et al. ..... 244/159.3
3,062,148 A * 11/1962 Le Bel ..... 244/159.3
3,090,580 A * 5/1963 Kehlet et al. ..... 244/159.3
(Continued)

FOREIGN PATENT DOCUMENTS

GB 1544727 * 4/1979 ..... F15B 11/16

OTHER PUBLICATIONS

No author listed, "X-15 Advanced Research Airplane Design Summary," North American Aviation, Inc., Los Angeles, California, USA; Report No. NA-55-221; dated May 9, 1955.*
(Continued)

*Primary Examiner* — Bernarr Gregory
(74) *Attorney, Agent, or Firm* — Renner, Otto, Boisselle & Sklar, LLP

(57) ABSTRACT

An air vehicle, such as a missile, for example an interceptor, includes control surfaces and a vectored thrust system, both used for steering the missile. A controller is operatively coupled to both steering mechanisms, and is configured to operate in a low dynamic pressure mode, which uses the vectored thrust system for at least part of the steering, only when the dynamic pressure is low, such as when the missile is at high altitude. At higher dynamic pressure, such as at lower altitude, the controller is configured to operate in a high dynamic pressure mode that uses only the control surfaces for steering. This allows the interceptor to operate at higher altitudes than interceptors that use only control surfaces for steering during flight. During flight for a high altitude interception the missile shifts from the high dynamic pressure mode to the low dynamic pressure mode.

18 Claims, 2 Drawing Sheets

(51) Int. Cl.
*F42B 10/66* (2006.01)
*F42B 10/00* (2006.01)

(56) References Cited

U.S. PATENT DOCUMENTS

| | | | | | |
|---|---|---|---|---|---|
| 3,124,737 | A | * | 3/1964 | Miller et al. | 318/565 |
| 3,128,964 | A | * | 4/1964 | Le Bel | 244/159.1 |
| 3,170,657 | A | * | 2/1965 | Riebe et al. | 244/159.3 |
| 3,261,571 | A | * | 7/1966 | Pinnes | 244/159.3 |
| 3,276,722 | A | * | 10/1966 | Eggers, Jr. et al. | 244/159.3 |
| 3,576,298 | A | * | 4/1971 | Barnett et al. | 244/159.3 |
| 4,085,909 | A | * | 4/1978 | East et al. | 244/3.21 |
| 4,901,949 | A | * | 2/1990 | Elias | 244/63 |
| 5,031,857 | A | * | 7/1991 | MacConochie et al. | 244/3.28 |
| 5,190,246 | A | * | 3/1993 | MacConochie | 244/171.3 |
| 5,631,830 | A | | 5/1997 | Schroeder | |
| 5,678,784 | A | * | 10/1997 | Marshall et al. | 244/171.4 |
| 6,193,187 | B1 | * | 2/2001 | Scott et al. | 244/171.1 |
| 6,315,239 | B1 | * | 11/2001 | Voigt | 244/3.22 |
| 6,446,905 | B1 | * | 9/2002 | Campbell et al. | 244/173.1 |
| 6,450,452 | B1 | * | 9/2002 | Spencer et al. | 244/159.3 |
| 6,454,216 | B1 | * | 9/2002 | Kiselev et al. | 244/159.3 |
| 6,612,522 | B1 | * | 9/2003 | Aldrin et al. | 244/2 |
| 6,616,092 | B1 | * | 9/2003 | Barnes et al. | 244/2 |
| 7,240,878 | B2 | * | 7/2007 | Towne | 244/159.3 |
| 7,281,682 | B2 | * | 10/2007 | D'Auvergne | 244/63 |
| 7,566,026 | B2 | * | 7/2009 | Lam et al. | 244/3.15 |
| 7,791,006 | B2 | | 9/2010 | Hasson et al. | |
| 8,168,929 | B2 | * | 5/2012 | Ustinov | 244/3.25 |
| 8,403,254 | B2 | * | 3/2013 | Ustinov | 244/2 |
| 8,500,070 | B2 | * | 8/2013 | Im | 244/158.9 |
| 8,528,853 | B2 | * | 9/2013 | Luther | 244/158.9 |
| 8,534,598 | B2 | * | 9/2013 | Salkeld | 244/171.3 |
| 8,624,171 | B2 | * | 1/2014 | Frey, Jr. | 244/3.22 |
| 8,648,285 | B2 | * | 2/2014 | Rastegar et al. | 244/3.14 |
| 8,702,041 | B2 | * | 4/2014 | Chavagnac et al. | 244/158.9 |

OTHER PUBLICATIONS

Dennis R. Jenkins, "Hypersonics Before the Shuttle: A Concise History of the X-15 Research Airplane"; "Monographs in Aerospace History," No. 18; Jun. 2000; NASA Publication SP-2000-4518; NASA Headquarters, Washington, DC, USA.*

No author listed, "Forty Years ago in the X-15 Flight Test Program, Nov. 1961-Mar. 1962," posted at www.air-and-space.com, no date given, accessed on Sep. 12, 2014.*

No author listed, entry for "North American X-15," Wikipedia, no date given; posted at wikipedia.org; accessed on Sep. 17, 2014.*

* cited by examiner

AIR VEHICLE WITH CONTROL SURFACES AND VECTORED THRUST

BACKGROUND OF THE INVENTION

1. Field of the Invention

The invention is in the field of missiles, and systems and methods for guiding missiles.

2. Description of the Related Art

Missiles have used control surfaces to maneuver the missiles toward targets, such as when intercepting an incoming object. Aerodynamic control from control surfaces loses effectiveness at high altitudes, where air is thinner. It would be desirable to have a missile that could maneuver at higher altitudes, for example to intercept high-altitude objects.

SUMMARY OF THE INVENTION

According to an aspect of the invention, an air vehicle, such as a missile is steerable by both control surfaces and vectored thrust. The control surfaces may be used to maneuver at lower altitudes (higher dynamic pressure), and vectored thrust may be used for maneuver at higher altitudes (lower dynamic pressure), either as a supplement to or a substitute for the control surfaces.

According to another aspect of the invention, an air vehicle uses a multiple-pulse rocket motor for launch, maneuvering at high altitudes, and/or acceleration toward a target, for instance to intercept a moving target.

According to yet another aspect of the invention, an air vehicle includes: movable control surfaces for steering the air vehicle; a thrust system that provides vectored thrust for steering the air vehicle; and a controller operatively coupled to the control surfaces and the vectored thrust system. The controller shifts during flight of the air vehicle from a high dynamic pressure mode, in which the controller uses only the control surfaces to steer the air vehicle, to a low dynamic pressure mode, in which the controller uses the vectored thrust system to provide at least part of the steering of the air vehicle.

According to still another aspect of the invention, a method of operating an air vehicle includes: launching the air vehicle; and after the launching, steering the interceptor both in a high dynamic pressure mode, in which the steering involves only movable control surfaces of the air vehicle to steer the air vehicle, and in a low dynamic pressure mode, in which the steering uses a vectored thrust system of the air vehicle to provide at least part of the steering of the air vehicle. The steering includes shifting between the high dynamic pressure mode and the low dynamic pressure mode during flight of the air vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An air vehicle, such as a missile, for example an interceptor, includes control surfaces and a vectored thrust system, both used for steering the missile. A controller is operatively coupled to both steering mechanisms, and is configured to operate in a low dynamic pressure mode, which uses the vectored thrust system for at least part of the steering, only when the dynamic pressure is low, such as when the missile is at high altitude. At higher dynamic pressure, such as at lower altitude, the controller is configured to operate in a high dynamic pressure mode that uses only the control surfaces for steering. This allows the interceptor to operate at higher altitudes than interceptors that use only control surfaces for steering during flight. During flight for a high altitude interception the missile shifts from the high dynamic pressure mode to the low dynamic pressure mode. The thrust is provided by a multiple pulse rocket motor, with one pulse reserved for acceleration and maneuvering in a terminal phase of flight right before target impact.

Figure 1:
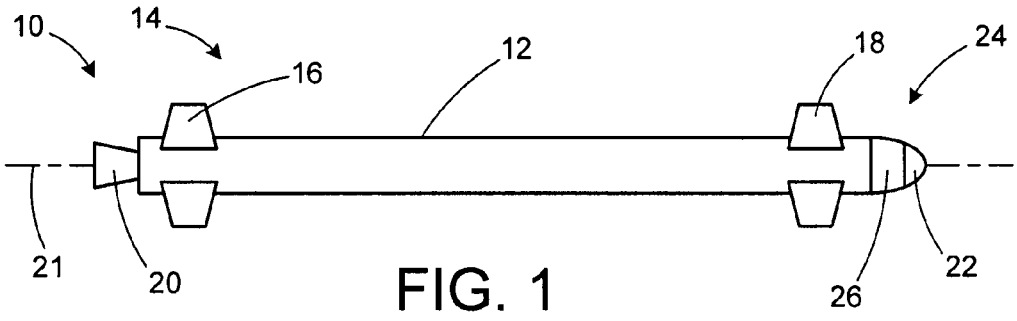
FIG. 1 is a side view of an air vehicle (a missile) in accordance with an embodiment of the present invention.

FIG. 1 shows an air vehicle, in the illustrated embodiment a missile 10, an interceptor that is used to intercept an incoming missile, projectile, or other object or target. Although the illustrated embodiment and description below relate to a missile, the air vehicle alternatively may be another type of air vehicle, such as a space plane or reusable space craft. The missile 10 includes a fuselage 12 that has movable control surfaces 14 that are used for maneuvering the missile 10. The control surfaces 14 in the illustrated embodiment include both fins 16 and canards 18, but one or the other of these sets of control surfaces may be omitted. Alternatively or in addition, the control surfaces 14 may include wings that are movable in whole or in part, to vary aerodynamic forces on the missile 10 in order to steer the missile 10. The movable control surfaces 14 may be moved by rotating them relative to the fuselage 12 about respective axes (or otherwise moving the control surfaces 14 relative to the fuselage 12), moving parts of the control surfaces 14 relative to other parts (as in the deflection of a flap), or warping, to give a few examples. Suitable hydraulic, electrical, or other actuators may be used to move the control surfaces 14.

The missile 10 also includes a thrust system 20. The thrust system 20 provides vectored thrust for steering the missile or interceptor 10. The thrust system 20 may also be used to provide forward thrust to the missile 10, for example to accelerate the missile 10. As described in greater detail below, the vectored thrust of the thrust system 20 may include one or more gimbaled nozzle that can be adjusted to provide thrust in any of a variety of directions, vectoring the thrust relative to a longitudinal axis 21 of the missile 10. The thrust system 20 may be a multiple-pulse rocket motor, capable of providing multiple increments of thrust at different times, as needed.

The missile 10 may have a seeker 22 at a nose 24 of the fuselage 12. The seeker 22 is used for guiding the missile 10 to a target. The seeker 22 may be gimbaled to maintain tracking of the target even as the missile changes orientation, by rotation or other steering. The seeker 22 may include a radar system or an electro-optical sensor, for example.

A lethality enhancement device or other payload 26 may be located aft of the seeker 22 and any associated sensors. The lethality enhancement device 26 may be a warhead, a net, or a mechanism for increasing the effective impact area of the missile 10, to increase the likelihood of the missile 10 impacting a target in a hit-to-kill function. Such a mechanism may include, for example, arms that extend out from the fuselage 12 as the missile 10 nears its target. A warhead could be blast fragment or kinetic energy rod (KER) warhead, perhaps with guidance-integrated fuzing (GIF) that may aid in guiding the missile 10. Control surfaces in a guidance-integrated fuze may be among the control surfaces of the missile 10.

Figure 2:
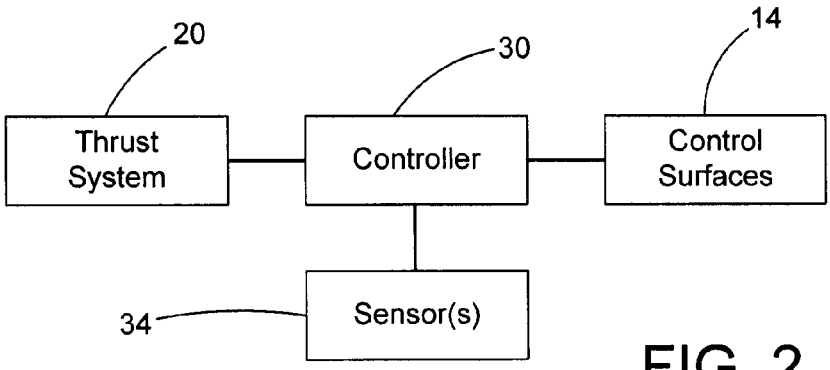
FIG. 2 is a high-level flow chart, illustrating parts of a control system of the missile of FIG. 1.

With reference now in addition to FIG. 2, the missile 10 has a controller 30 that controls both the movable control surfaces 14 and the thrust system 20. As discussed above, the movable control surfaces 14 and the thrust system 20 both can be used to steer the missile 10. The controller 30 controls which of these (or both) is used to control the steering of the missile 10. The controller 30 shifts operation as a function of dynamic pressure, which is proportional the density of the air at the altitude of the missile 10, and is also proportional to the square of the missile's speed. In particular, the controller 30 is able to shift during flight between a high dynamic pressure mode and a low dynamic pressure mode. The high dynamic pressure mode is used when the missile 10 is at high dynamic pressure flight, and in the high dynamic pressure mode the missile 10 relies primarily (and perhaps exclusively) on the movable control surfaces 14 for steering. The low dynamic pressure mode is used in low dynamic pressure flight, for instance when the missile 10 is at high altitude. In the low dynamic pressure mode the steering of the missile 10 includes use of the thrust system 20 for steering. The movable control surfaces 14 may also be used for steering in the low dynamic pressure mode, although the thrust system 20 may be primarily responsible for steering the missile 10 in the low dynamic pressure mode.

The controller 30 may receive input from one or more sensors, for use in determining which of the modes to operate the missile 10. Input may be provided by a sensor 34 that provides information on dynamic pressure. The sensor 34 may be a pitot tube or other dynamic pressure measurement device. Alternatively, the sensor 34 may represent multiple information sources that each provide part of the information from which dynamic pressure may be determined. For example the controller 30 may receive data on airspeed, altitude, and/or static pressure from different sources, and combine that data to determine the dynamic pressure. The sensor 34 may be a separate sensor that provides output directly to the controller 30, or it may represent output that passes through other devices, and may be used for other purposes. In situations where aerodynamic control is sufficient to steer the missile 10, it may be generally preferred by the controller, so as to provide more flexibility to use the pulse thrusters later in flight. In addition, in the terminal end-flight (homing) mode, peak performance will be advantageous, and saving the pulse thrusters would not be of later value, and therefore thrust vectoring, if available, would be preferred to augment aerodynamic control.

The controller 30 may be embodied in a suitable computer or integrated circuit. It may be hardware and/or software. A suitable guidance system for guiding the missile 10 to its target, may be a part of or may be operatively coupled to the controller 30. The guidance may involve any of a variety of guidance mechanisms, including radar, infrared signals, or global positioning systems. The controller 30 and/or the guidance system may be in communication with other systems or devices external to the missile 10.

Figure 3:
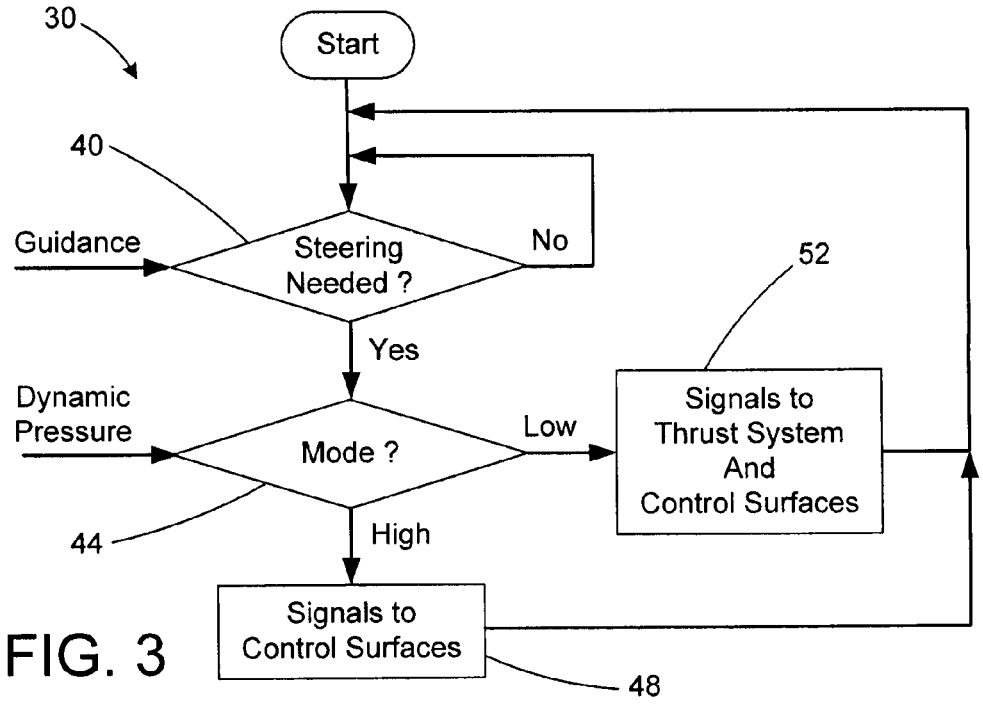
FIG. 3 is a block diagram, illustrating function of the control system of FIG. 2.

FIG. 3 is a high-level flow chart of operation of the controller 30. In step 40 the controller 30 makes a determination as to whether (and what sort of) steering of the missile is needed. This may involve input received from the guidance system. If steering is not needed, the controller waits for signals from the guidance system that steering is required.

If steering is required, in step 44 the controller 30 determines if steering should be accomplished in a high dynamic pressure mode, using only the control surfaces, or in a low dynamic pressure mode, with vectored thrust from the thrust system 20 used for at least some of the steering. The determination may be made ahead of time, with controller 30 updating the mode as the dynamic pressure rises or falls.

If the controller 30 is in the high dynamic pressure mode then the controller 30, in step 48, sends appropriate control signals to the control surfaces 14. This positions the control surfaces 14 to steer the missile 10 in an appropriate way. On the other hand, if the controller 30 is in the low dynamic pressure mode then the controller 30, in step 52, sends appropriate steering control signals to the thrust system 20 and the control surfaces 14. The control signals sent may vary based on the dynamic pressure, recognizing that as the dynamic pressure decreases a given positioning of the control surfaces 14 has less effect on steering.

Figure 4:
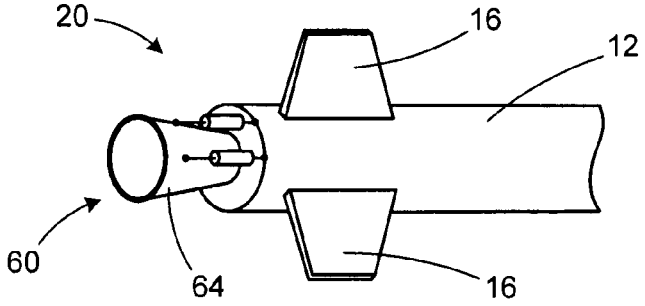
FIG. 4 is an oblique view of an aft part of the missile of FIG. 1, showing parts of the thrust system.
Figure 5:
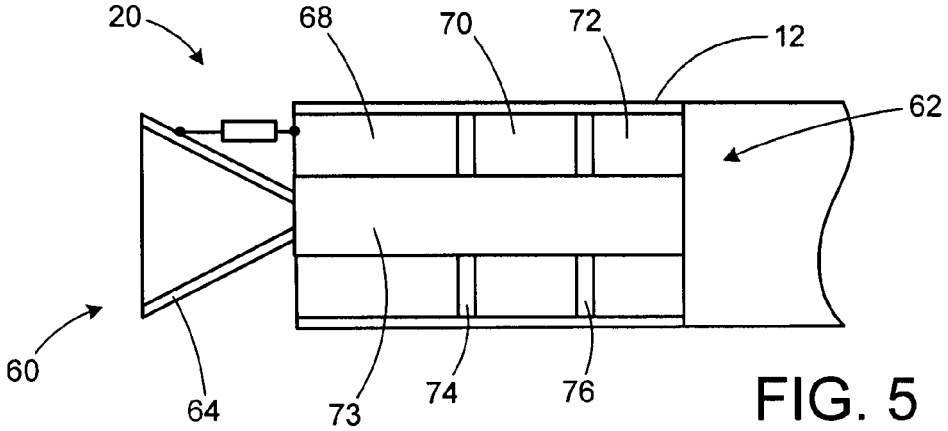
FIG. 5 is a cross-sectional view of the aft part of the missile shown in FIG. 4.

FIGS. 4 and 5 illustrate one embodiment of the thrust system 20, a multiple-pulse rocket motor 60. The thrust system 20 shown includes fuel 62 that produces pressurized gases that are expelled through one or more nozzles 64 to produce thrust. The fuel 62 may be a solid fuel, and may consist of multiple fuel portions 68, 70, and 72 that may be separately and individually ignited, to provide limited amounts of thrust when needed. Pressurized gasses from the fuel portions 68-72 travel down a central channel 73, and exit the missile 10 through the nozzle 64, providing thrust. Partitions 74 and 76 separate adjacent pairs of the partitions 68-72 from one another, to prevent burning in one of the fuel portions 68-72 from extending to the other fuel portions. The partitions may be made from any of a variety of suitable materials, such as suitable ceramics, metals, or polymers. There fuel partitions 68-72 are shown in the illustrated embodiment, although it will appreciated a different number of fuel partitions may be used.

The nozzle 64 may be a gimbaled nozzle that can be tilted to vector the thrust. Suitable mechanisms for tilting the nozzle 64 are known, for example in using a universal joint suspension for a thrust chamber that the nozzle 64 is part of. The mechanism may include a pair of actuators 76 and 78 for tilting the nozzle 64 is orthogonal directions. The mechanism for tilting the nozzle 64 may be operatively coupled to the controller 30 (FIG. 2), to allow the controller 30 to control how the thrust is vectored. The vectoring of thrust by the thrust system 20 is vectoring of thrust from the main motor of the missile 10, deviating the thrust from the longitudinal axis 21 of the missile 10.

As an alternative to the one nozzle 64 shown in the illustrated embodiment, multiple nozzles may be used, such as four nozzles in a cruciform arrangement. The multiple nozzles may be configured to be tilted separately, or may be configured to all tilt in the same direction.

Many other ways are possible for vectoring thrust. One example alternative is a flexible laminated bearing with a nozzle held by a ring of alternate layers of molded elastomer and spherically formed sheet metal. Another is a flexible nozzle joint that includes a sealed rotary ball joint. A third example is jet vanes, with four (or another number) rotating heat-resistant jet vanes movable into and/or within a jet of hot gasses emitted from the nozzle. A fourth example is a jetavator, a rotating airfoil-shape collar, gimbaled near the nozzle exit. A fifth example is jet tabs, four (or another number) of paddles that selectively rotate in and out of the hot gas exhaust from the nozzle. A sixth example is selective side injection of secondary fluid on one side of the nozzle diverge portion. A seventh example is use of small thrust-control chambers, gimbaled to provide auxiliary thrust in a desired direction.

The fuel portions 68-72 may be fired at different times, and for different purposes. For example, the fuel portion 68 may be fired to provide initial thrust when the missile is launched, to provide initial acceleration to the missile 10, and for setting the initial flight path. The fuel portion 70 may be fired for midflight maneuvering, when the missile is in the low dynamic pressure mode. The fuel portion 72 may be fired late in flight, to provide acceleration to the missile 10 as it approaches its target. This is only one example of multiple purposes for different of the fuel portions 68-72, and some or all of the fuel portions may perform more than one purpose when used. However, in general it is advantageous to have one fuel portion used to provide initial thrust, one fuel portion used for terminal flight maneuvering and acceleration, and one or more fuel portions used to provide thrust pulses for in-flight maneuvering while operating in the low dynamic pressure mode.

The fuel portion 68 is shown as larger than the fuel portions 70 and 72, to provide more thrust for initial acceleration than would be required for in-flight maneuvering and accelerating toward a target. This is only one possible arrangement for the sizes of the fuel portions 68-72. It may be advantageous for the initial fuel portion used to be larger than the intermediate fuel portions used during in-flight maneuvering, which may also be smaller than a last fuel portion used for maneuvering and acceleration in a terminal flight phase.

Alternatively the thruster 20 can use liquid rocket fuel, with valves used to control flow of fuel and oxidizer, to achieve the same effect of being able to fire thruster to provide multiple impulses of thrust, of identical or differing amounts, for any of a variety of purposes. The thruster also may be a hybrid liquid-solid fuel system.

Figure 6:
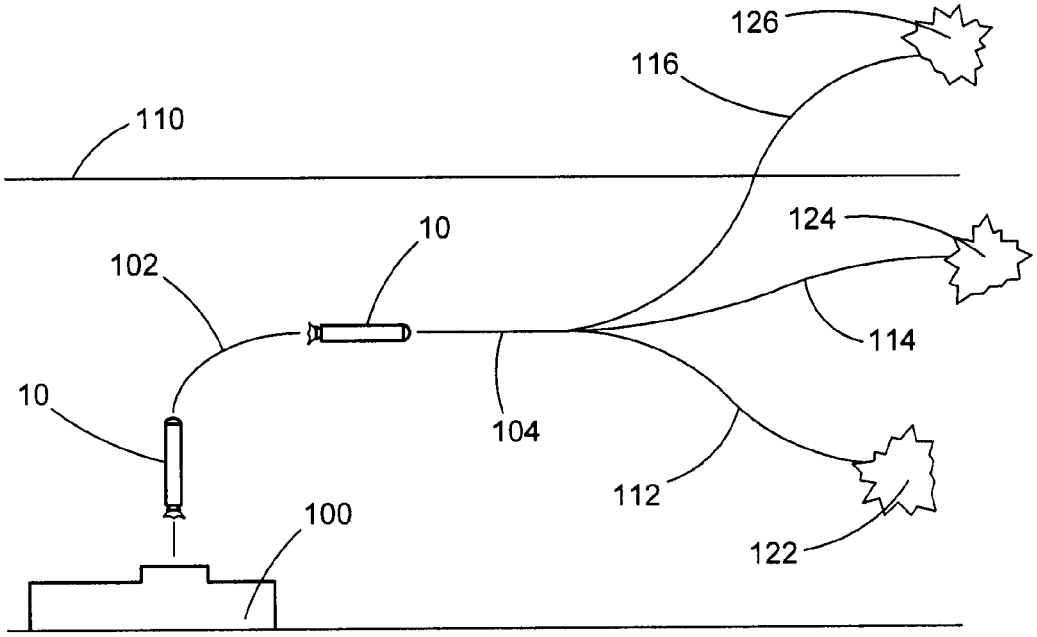
FIG. 6 is a diagram illustrating possible uses of the missile of FIG. 1.

FIG. 6 illustrates the process of the missile 10 being used to intercept a target. The missile 10 is launched from a launcher 100, which may be on the ground (a fixed location or movable vehicle), on the water (a ship or a submarine), or in the air (a flying aircraft). The thrust system 20 of the missile 10 may be used to provide thrust during launch, and may provide vectored thrust to pitch the missile 10 over, as shown at 102, to achieve a midcourse flight path 104. The thrust may be vectored to rotate the interceptor missile 10 such that axial acceleration is in the direction required to reduce the zero-effort miss (ZEM) for the missile 10. The midcourse flight path 104 may be at a low altitude, such that it is below a threshold altitude 110 at which the missile transitions from the high dynamic pressure mode to the low dynamic pressure mode. This allows the control surfaces 14 (FIG. 1) to be used for maneuvering during most of the flight. The altitude for which this transition occurs may be about 40 kilometers, for the airspeed at which the missile 10 flies.

Terminal flight paths 112, 114, and 116 show possible routs to engaging targets at locations 122, 124, and 126, at different altitudes. The terminal flight path 112 is used for engaging a conventional target, such as an aircraft or missile, at low altitude in an anti-aircraft warfare (AAW) function. The target in such a case may be a manned or unmanned aircraft of any of a variety of types and functions. The missile 10 in such a mission does not cross the threshold altitude 110, and therefore is maneuvered in the high dynamic pressure mode all the way to the target engagement at location 122. Even so, vectored thrust from the thrust system 20 may be used as the missile moves along the terminal flight path 112, to accelerate the missile 10 and/or to increase maneuverability of the missile 10 during the final phase of target interception, when the missile 10 may need to react quickly to evasion attempts by the target.

Terminal flight path 114 is to a higher altitude, still underneath the threshold altitude 110, where the missile engages a target such as a tactical ballistic missile or high-altitude cruise missile, at location 124. The maneuvering of the missile 10 may be similar to that described above for the flight path 112.

Terminal flight path 116 is above the threshold altitude 110, meaning that part of the flight occurs with the missile 10 in the low dynamic pressure mode. The ability of the missile 10 to operate at this high altitude extends its range, enabling it to be used against high-altitude targets of various types, such as different sorts of ballistic missiles, and high-altitude cruise missiles.

The flight of the missile 10 may include multiple transitions during flight between high dynamic pressure mode and low dynamic pressure mode. For example, maximize range may involve launching in low dynamic pressure mode (low-Q), fly through the atmosphere for a period of time in high dynamic pressure mode (high-Q), then flying at high altitudes in low dynamic pressure mode (low-Q), and thereafter returning to thicker air (lower altitude) to fly at low dynamic pressure mode (high-Q). A single flight may have multiple transitions from high dynamic pressure mode to low dynamic pressure mode, and/or multiple transitions from low dynamic pressure mode to high dynamic pressure mode.

The missile 10 provides added capability of engaging targets at a greater variety of heights, including heights at which conventional control surfaces may be inadequate for steering the missile, especially when closing in on a target. The missile 10 may be able to engage targets in the mesosphere and upper stratosphere (altitude of 30-80 kilometers), but still below the thermosphere. At the same time, the missile 10 has control surfaces that can handle most of the steering for the missile 10 as the missile 10 is guided at least to the vicinity of its target.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

movable control surfaces for steering the air vehicle;

a thrust system that provides vectored thrust for steering the air vehicle; and a controller operatively coupled to the control surfaces and the vectored thrust system;

wherein the thrust system is a multiple pulse rocket motor that is capable of providing multiple thrust pulses at different times, the thrust system including fuel and a nozzle operatively coupled to the fuel to produce thrust in various directions; and wherein the controller shifts during flight of the air vehicle from a high dynamic pressure mode, in which the controller uses only the control surfaces to steer the air vehicle, to a low dynamic pressure mode, in which the controller uses the vectored thrust system to provide at least part of the steering of the air vehicle.

2. The air vehicle of claim 1, wherein the thrust system also provides thrust to accelerate the air vehicle toward a target.

3. The air vehicle of claim 1, wherein the nozzle is a gimbaled nozzle.

4. The air vehicle of claim 1, wherein the control surfaces are movably coupled to a fuselage of the air vehicle.

5. The air vehicle of claim 4, wherein the control surfaces include canards that are movable relative to the fuselage.

6. The air vehicle of claim 4, wherein the control surfaces include fins that are movable relative to the fuselage.

7. The air vehicle of claim 1, wherein the air vehicle is an interceptor that includes a lethality enhancement device for defeating an airborne device that is intercepted by the air vehicle.

8. The air vehicle of claim 1, wherein the controller uses dynamic pressure, as a function of at least altitude of the air vehicle and airspeed of the air vehicle, to shift between the modes.

9. The air vehicle of claim 1, wherein the controller, in the low dynamic pressure mode, also uses the control surfaces to steer the air vehicle.

10. An air vehicle comprising:

movable control surfaces for steering the air vehicle;

a thrust system that provides vectored thrust for steering the air vehicle; and a controller operatively coupled to the control surfaces and the vectored thrust system;

wherein the thrust system includes fuel and a nozzle operatively coupled to the fuel to produce thrust in various directions;

wherein the fuel has multiple solid fuel portions that are separately ignitable, so as to produce multiple thrust pulses at different times; and wherein the controller shifts during flight of the air vehicle from a high dynamic pressure mode, in which the controller uses only the control surfaces to steer the air vehicle, to a low dynamic pressure mode, in which the controller uses the vectored thrust system to provide at least part of the steering of the air vehicle.

11. The air vehicle of claim 10, further comprising partitions between the fuel portions.

12. A method of operating an air vehicle, the method comprising:

launching the air vehicle; and after the launching, steering the interceptor both in a high dynamic pressure mode, in which the steering involves only movable control surfaces of the air vehicle to steer the air vehicle, and in a low dynamic pressure mode, in which the steering uses a vectored thrust system of the air vehicle to provide at least part of the steering of the air vehicle;

wherein the thrust system is a multiple pulse rocket motor that is capable of providing multiple thrust pulses at different times;

wherein the steering includes shifting between the high dynamic pressure mode and the low dynamic pressure mode during flight of the air vehicle: and wherein the steering in the low dynamic pressure mode includes saving at least one of the thrust pulses for use in a terminal flight portion that includes guiding the air vehicle to a target.

13. The method of claim 12, wherein the shifting includes a shifting from the high dynamic pressure mode to the low dynamic pressure mode.

14. The method of claim 13, wherein the shifting from the high dynamic pressure mode to the low dynamic pressure mode occurs while the air vehicle is at an altitude of at least 20 kilometers.

15. The method of claim 12, wherein the shifting includes shifting between the high dynamic pressure mode and the low dynamic pressure mode multiple times during the flight of the air vehicle.

16. The method of claim 12, wherein the target is a moving target; and wherein the guiding the air vehicle to the target includes using the at least one of the thrust pulses to maneuver the air vehicle, in the terminal flight portion, to neutralize the moving target.

17. The method of claim 12, wherein the launching includes accelerating the air vehicle using the thrust system.

18. The method of claim 17, further comprising changing orientation of the air vehicle, using the vectored thrust system, after the launching and prior to the steering.

* * * * *